US005977497A

United States Patent [19]

Tsunematsu

[11] Patent Number: 5,977,497

[45] Date of Patent: Nov. 2, 1999

[54] RELIABLE SWITCH FOR IC CARDS

[75] Inventor: Kazuhisa Tsunematsu, Tokyo, Japan

[73] Assignee: Hirose Electric Co., Ltd., Tokyo, Japan

[21] Appl. No.: 09/076,865

[22] Filed: May 13, 1998

[30] Foreign Application Priority Data

May 23, 1997 [JP] Japan ..... 9-148414

[51] Int. Cl.[6] ..... H01H 1/26

[52] U.S. Cl. ..... 200/283; 200/284; 200/246

[58] Field of Search ..... 200/283, 284, 200/246, 247

[56] References Cited

U.S. PATENT DOCUMENTS 3,790,726 2/1974 Brown ..... 200/284 X
4,672,158 6/1987 Baynes et al. ..... 200/283
4,866,228 9/1989 Osamu .
4,888,457 12/1989 Miyakawa ..... 200/283
4,900,273 2/1990 Michel .

FOREIGN PATENT DOCUMENTS 2 180 842 11/1973 France .

*Primary Examiner*—Renee S. Luebke
*Attorney, Agent, or Firm*—Kanesaka & Takeuchi

[57] ABSTRACT

A switch device comprises an insulative housing and a pair of switch terminals each having an outside connection section and an inside section in the housing. The first switch terminal 5 has a plurality of flexible arms 8A, 8B with a free end. Each flexible arm has a movable contact point so that when the flexible arms receive pressure, they are flexed to bring the respective movable contact points into contact with the fixed contact 14 of the second switch terminal 6, thus providing a reliable switching mechanism.

4 Claims, 4 Drawing Sheets

RELIABLE SWITCH FOR IC CARDS

BACKGROUND OF THE INVENTION

1. Filed of the Invention

The present invention relates to switch devices and particularly to a switch device to be turned on or off by the connecting operation of a connecting member which has an electronic circuit, etc.

2. Description of the Related Art

Japanese patent application Kokoku No. 23879/96 discloses a switch device of this type. This device has a contact frame for reading IC cards and comprises a flat frame made of an insulative material so as to provide a window section, and a plurality of contact elements and a pair of switch terminals provided on the flat frame. The contact elements and the switch terminals have connection sections projecting from the frame and contact sections for making spring contact with the corresponding circuit traces of a card. The switch terminals have a fixed contact and a movable contact supported at one end by the frame, with the other end free. The other end of the movable contact is pressed by the inserted card and flexed away from the fixed contact of the other terminal, thus breaking the contact.

For easy manufacturing, the switch terminals are made by stamping a metal sheet and bending the end of a movable contact in a semi-cylindrical form so that both the switch terminals make contact with each other in a line.

The above switch device, however, suffers from low reliability in contact between the switch terminals. If the fixed contact has a completely flat contacting surface and is completely parallel to the contact surface of the semi-cylindrical movable contact, they make a perfect line contact. However, there is always a manufacturing difference although it is within the range of tolerance and it is very difficult to make a line contact but a point contact or contacts. Especially, when the above error makes an angular contact between them, it is almost impossible to make a line contact.

If dirt or dust adheres to the contact, it is not unusual to make poor contact.

SUMMARY OF THE INVENTION

Accordingly, it is an object of the invention to provide a switch device having the improved contact reliability.

The switch device according to the invention comprises an insulative housing and a pair of switch terminals each having an outside section and an inside section within the housing. The inside section of at least one of the switch terminals is provided with a flexible section with a free end. A movable contact is provided on the flexible section so that when the flexible section receives a pressure at a press portion, it is flexed to form a switching mechanism together with the fixed contact.

In the switch device, the flexible section of the first switch terminal is provided with a plurality of flexible arms each having a movable contact point.

According to the invention, the first switch terminal makes contact with the second switch terminal at a plurality of flexible contact points so that even if there is a small manufacturing error, the respective contact points make a good contact although the contact pressures are slightly different, thus assuring a reliable contact. In addition, if dirt or dust adheres to one of the contact points, the other contact points make a good contact.

According to one embodiment of the invention, the flexible arms of the first switch terminal are made by providing slits in a metal sheet so that the flexible arms have movable contact points in the middle and the press portions at the free ends. The press portions of the flexible arms receive a pressure from an inserted card or the like to start the switching operation.

Since the press portions extend in parallel in the direction of the card thickness, they abut the card across the card thickness, assuring transmission of the pressure.

Since a cut is provided in the outside section of the first switch terminal, the connection portion of the second switch terminal extends through the cut, making the switch device compact or reducing the height of the device.

BRIEF DESCRIPTION OF THE INVENTION

DESCRIPTION OF THE PREFERRED EMBODIMENT

An insulative housing 1 has a support section for holding switch terminals and a slot for receiving a card C with an electronic circuit so that the front end C1 of the card C abuts against the abutment face 1A of the insulative housing 1. The card C has a connection pads on the backside.

A plurality of contact elements 2 are provided in the housing 1 so that the connection sections project from the front end of the housing 1 and the contact sections extend to the slot for making spring contact with the connection pads of the card.

A pair of support grooves 3 and 4 extend laterally in the front portion of the housing 1 for receiving a pair of switch terminals 5 and 6 in a cantilevered fashion.

Figure 3:
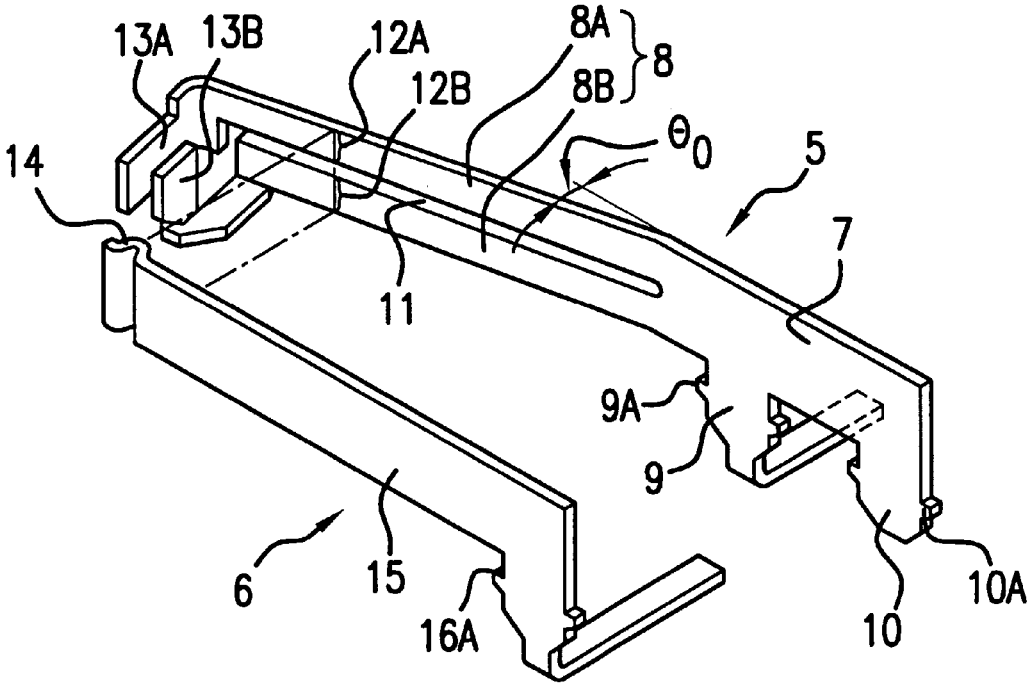
FIG. 3 is a perspective view of a pair of switch terminals for the switch device of FIG. 1.

In FIG. 3, the switch terminals 5 and 6 are made by bending a metal sheet so as to provide extended arms. The first switch terminal 5 has a fixing section 7 press-fitted into the support groove 3 and a movable section 8 extending inwardly from the fixing section 7 to such an extent that it is flexible in the direction of thickness so as to make a switch mechanism for a card which has a side edge having a notch to prevent wrong insertion.

A connection portion 9 and a retaining portion 10 extend downwardly from the fixing section 7 and have projections 9A and 10A, respectively, for assuring engagement with the support groove 3 of the housing 1. The connection portion 9 projects from the housing to provide an outside portion and extends laterally for facilitating wiring connection.

The movable section 8 is bent at an angle of θ with respect to the plane of the fixing section 7 to provide a satisfactory pressure with which it contacts with the other switch terminal 6. A slit 11 is provided in the movable section 8 to provide a pair of flexible arms 8A and 8B. If necessary, more slits may be provided to provide more flexible arms. The flexible arms 8A and 8B have flat movable contacts 12A and 12B near the free ends. The free ends are bent toward the other switch terminal 6 in the form of an L-shape. The flexible arm 8A is bent once while the flexible arm 8B is bent twice to provide press portions 13A and 13B. The press portions 13A and 13B are made sufficiently large to receive a pressure from the end face of a card. The press portions 13A and 13B have a surface lying in a plane substantially parallel to the plane of the movable section 8 at the inclination angle of θ with respect to the fixing section 7.

The second switch terminal 6 has a fixing section 15 which is press-fitted in the support groove 4 of the housing and is flat through the entire length thereof except for a fixed contact 14 provided at the front end. A connection portion 16 extends downwardly from the rear end of the fixing section to provide an outside portion and has an engaging projection 16A which is similar to the projection 9A of the connection portion 9. As shown in FIG. 3, like the connection portion 9, the connection portion 16 is bent in the form of an L-shape at a position corresponding to the space between the connection portion 9 and the retaining portion 10 of the first switch terminal 5. The fixed contact 14 takes a semi-cylindrical form to facilitate contact with the first switch terminal 5.

Figure 1:
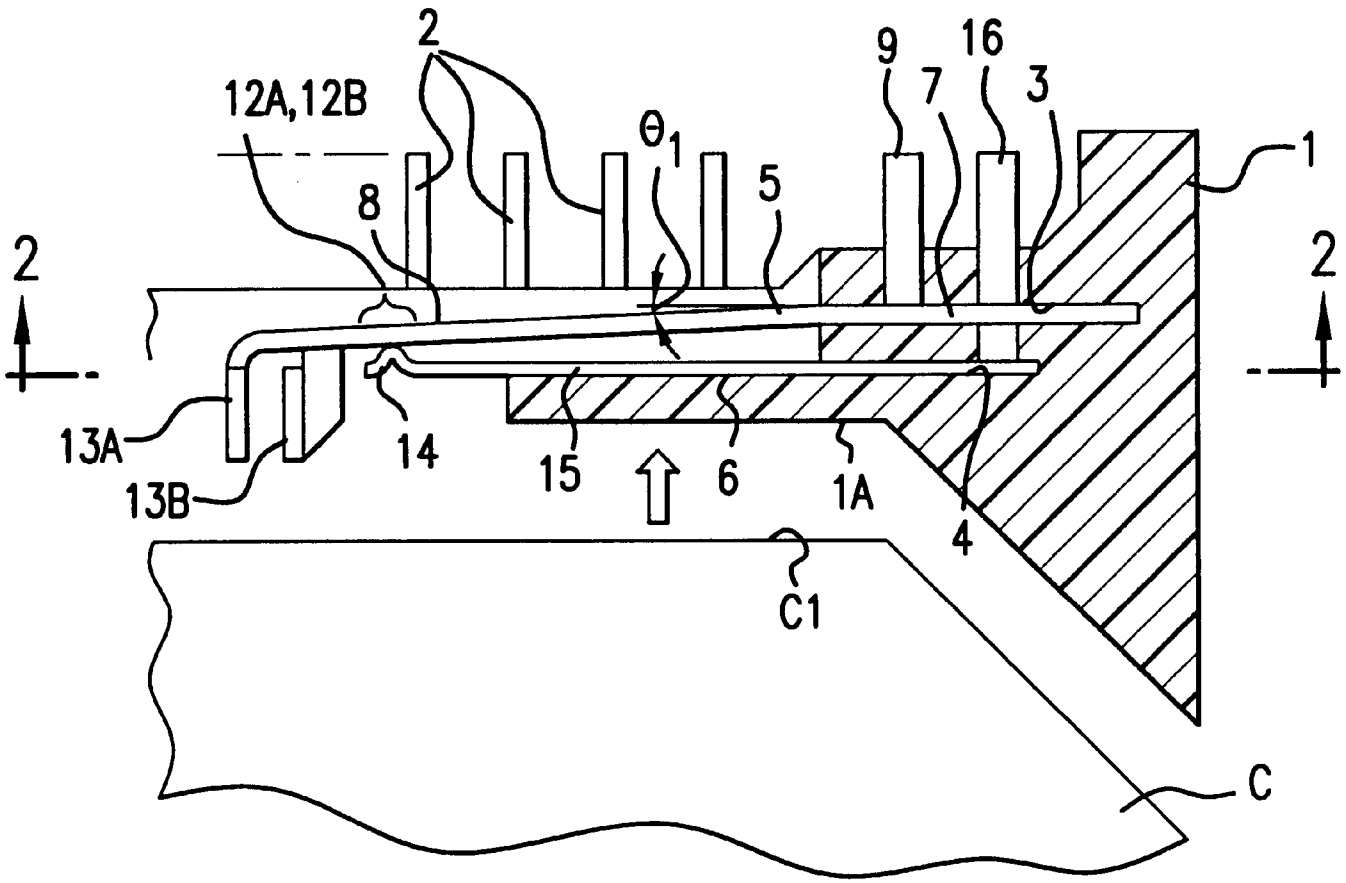
FIG. 1 is a sectional view of a switch device according to an embodiment of the invention.
Figure 2:
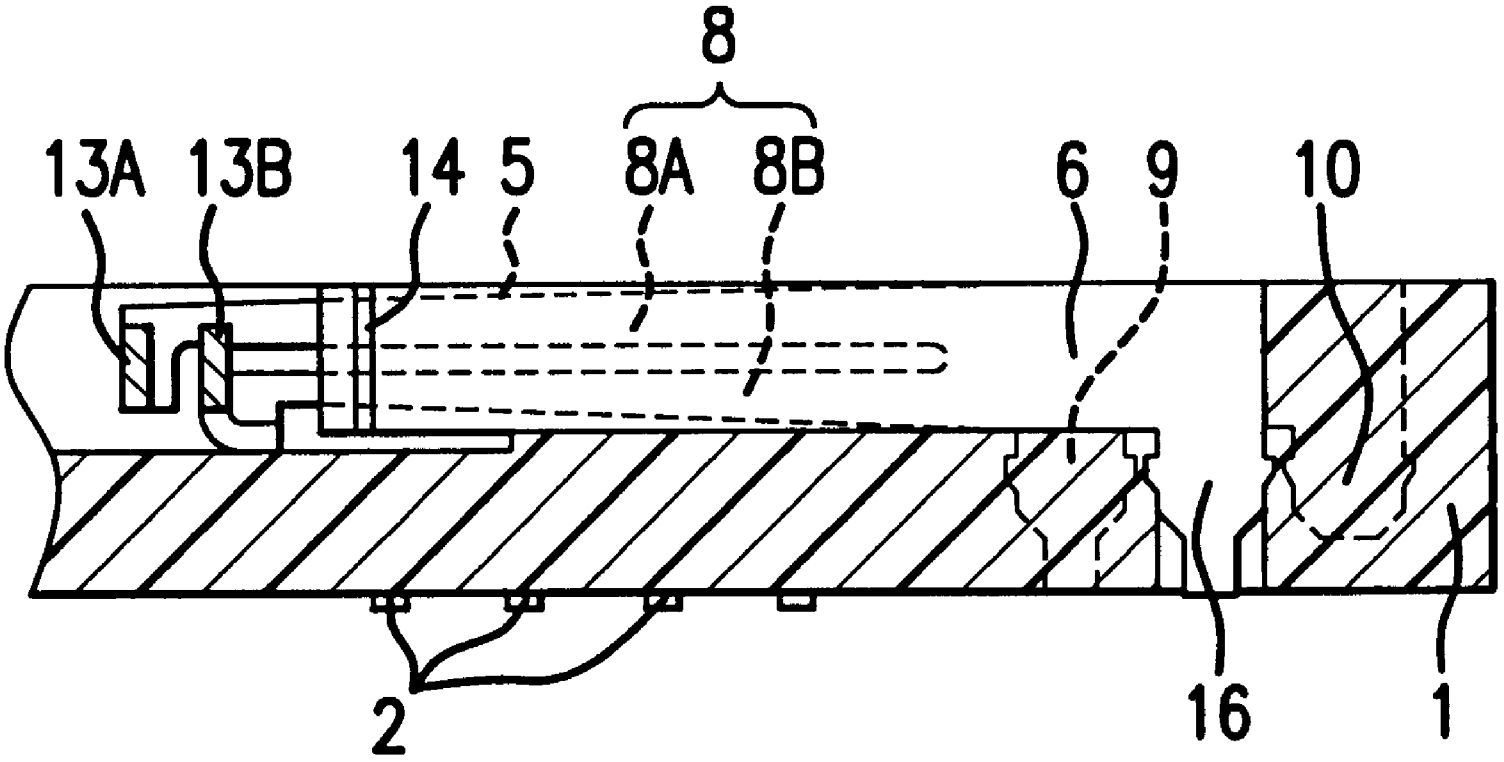
FIG. 2 is a sectional view taken along line 2—2 of FIG. 1.

The fixing sections 7 and 15 of the switch terminals 5 and 6 are press-fitted in the support grooves 3 and 4 of the housing. As shown in FIG. 1, the switch terminals 5 and 6 are set so close to each other that the movable contacts 12A and 12B of the first switch terminal 5 are brought into spring contact with the fixed contact 14 of the second switch terminal 6 with an initial contact pressure. Consequently, the movable portion 8 of the first switch terminal 5 is flexed slightly, providing an inclination angle θ, which is smaller than the initial inclination angle θ.

In FIG. 1 wherein the connection portions 9 and 16 of the switch terminals 5 and 6 are soldered to a circuit board, the movable contacts 12A and 12B and the fixed contact 14 are in contact with each other to make a closed circuit. Under such conditions, the flexible arms 8A and 8B of the movable section 8 are flexible independently from each other and in contact with the fixed contact 14 with the initial contact pressure so that if there is a small manufacturing error, only the contact pressure is slightly different between the two flexible arms 8A and 8B, and a good contact between the fixed contact 14 and the flexible arms 8A and 8B is provided. Even if dust or dirt adheres to one of the flexible arms, it is possible to assure a good contact by the other flexible arm.

Figure 4:
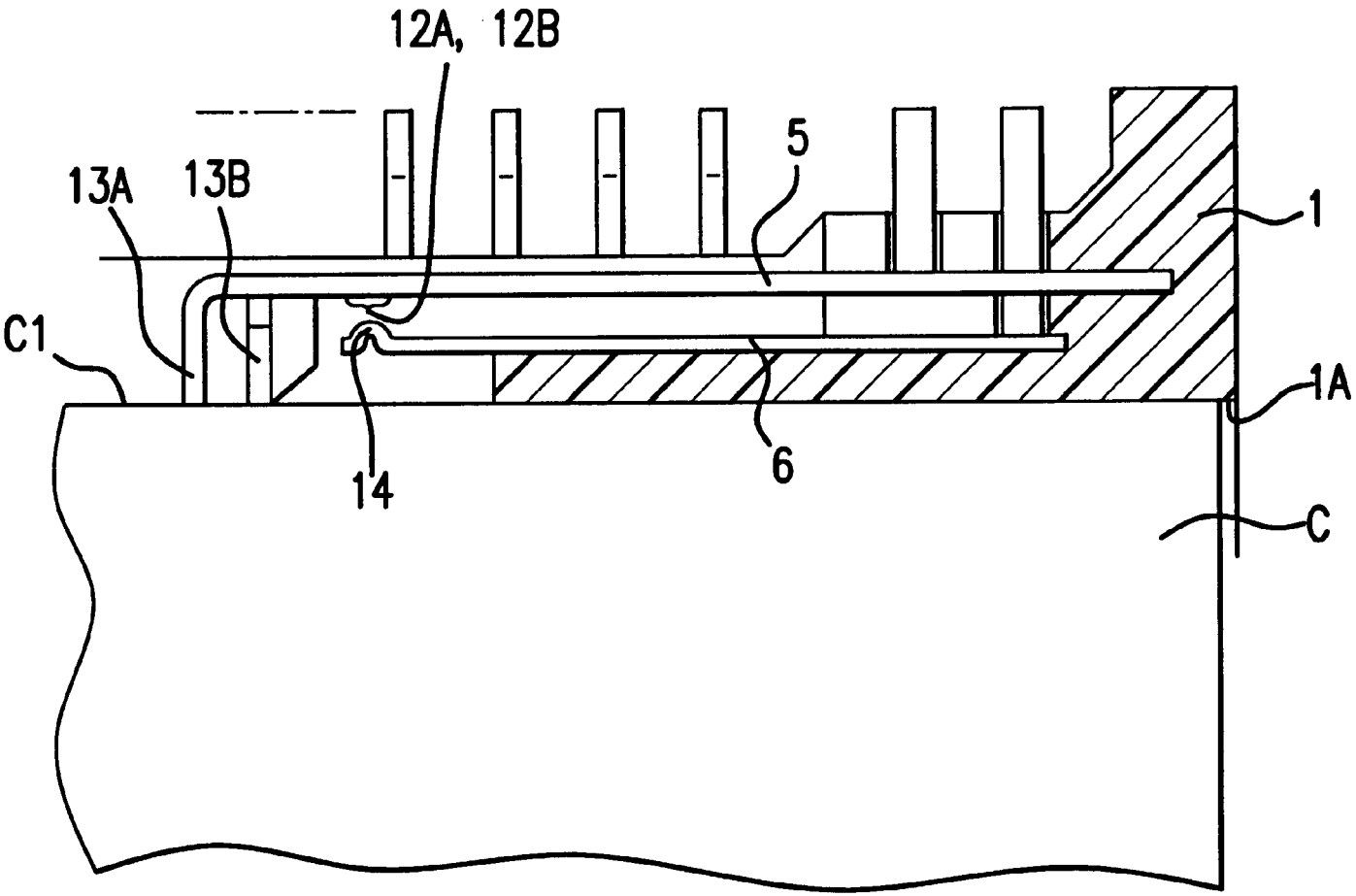
FIG. 4 is a sectional view of the switch device into which a card is inserted.

As shown in FIG. 1, when the card C is put into the housing 1, the front end C1 of the card C presses simultaneously the press portions 13A and 13B of the first switch terminal 5. The flexible arms 8A and 8B or movable section 8 is then flexed away from the second switch terminal 6 so that the contact pressure between the movable contacts 12A and 12B and the fixed portions 14 decreases to zero at which the first switch terminal 5 is separated from the second switch terminal 6, bringing the two switch terminals into the open condition (see FIG. 4). Then, the front end C1 of the card C reaches the abutment face 1A of the housing and is held in place while the contact elements 2 are brought into contact with the circuit traces provided on the back of the card C. When the card C is pulled out of the housing 1, the switch terminals 5 and 6 return to the original closed condition.

In the above embodiment, the switch terminals are changed from the closed state to the open state by the insertion of a card, but it is possible to change the open state to the closed state according to the invention. It is only necessary to deform the movable portion by the insertion of a card so that the flexible contacts and the fixed contact are brought into contact with each other.

The connection portion 16 of the second switch terminal 6 extends out of the housing 1 through a space between the connection portion 9 and the retaining portion 10 of the first switch terminal 5.

According to the invention, a plurality of flexible arms are provided at the first switch terminal and contacted with the second switch terminal so that even if there is a small manufacturing error, it is possible to assure a good contact with a plurality of contact spots. In addition, if dirt or dust adheres to one of the contact points, the other contact points, assure a good contact, thus maximizing the contact reliability of the switch.

What is claimed is:

1. A switch device comprising:

an insulative housing having an opening for receiving a card having a front face;

a first switch terminal extending in parallel with the front face of the card and having a first fixing section which is supported by the insulative housing, a movable section extending inwardly from the first fixing section of the first switch terminal, wherein the movable section comprises a plurality of flexible arms formed by a slit provided in the movable section and extending from the first fixing section of the first switch terminal in the longitudinal direction of the movable section, each of the flexible arms comprising a movable contact provided near a free end of each of the flexible arms and a press portion provided at the free end of each of the flexible arms, wherein each of the press portions receives a pressure from the front face of the card inserted into the insulative housing such that each of the press portions flexes each of the flexible arms in a direction in parallel with a plane where the card lies;

a second switch terminal extending in parallel with the front face of the card and having a second fixing section supported by the insulative housing and a second connection portion extending outwardly from the second fixing section of the second switch terminal and comprising a fixed contact provided at a front end of the second switch terminal at a position corresponding to the movable contacts so that the fixed and movable contacts make a switching mechanism.

2. A switch device according to claim 1, wherein said movable contacts lie in a first plane and said press portions lie in a second plane which is different from the first plane.

3. A switch device according to claim 2, wherein said press portions of said flexible arms extend in parallel and in a direction of thickness of said card, thereby minimizing necessary space for said switch device.

4. A switch device according to claim 1, which further comprises a connection portion and a retaining portion provided at the first fixing section of said first switch terminal to form a space between them so that said second connection portion of said second switch terminal extends through the space, thereby minimizing the height of said switch device.

* * * * *